US007143747B2

(12) United States Patent
Uchiyama

(10) Patent No.: US 7,143,747 B2
(45) Date of Patent: Dec. 5, 2006

(54) COMMON RAIL FUEL INJECTION SYSTEM

(75) Inventor: Ken Uchiyama, Toyoake (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/222,038

(22) Filed: Sep. 9, 2005

(65) Prior Publication Data

US 2006/0054149 A1 Mar. 16, 2006

(30) Foreign Application Priority Data

Sep. 10, 2004 (JP) ..... 2004-264246

(51) Int. Cl.
*F02M 69/46* (2006.01)
*F02M 69/54* (2006.01)

(52) U.S. Cl. ..... 123/456; 123/198 D

(58) Field of Classification Search ..... 123/456, 123/198 D, 497, 458, 447; 701/103, 107; 73/119 A, 118.1
See application file for complete search history.

(56) References Cited

U.S. PATENT DOCUMENTS 6,234,148 B1 * 5/2001 Hartke et al. ..... 123/447
6,526,948 B1 * 3/2003 Stavnheim et al. ..... 123/497
6,712,047 B1 * 3/2004 Rueger ..... 123/479
6,871,633 B1 * 3/2005 Date et al. ..... 123/447
6,928,880 B1 * 8/2005 Kang et al. ..... 73/756
2005/0005912 A1 * 1/2005 Joos et al. ..... 123/458

FOREIGN PATENT DOCUMENTS

JP 2003-222045 8/2003

* cited by examiner

*Primary Examiner*—Mahmoud Gimie
(74) *Attorney, Agent, or Firm*—Nixon & Vanderhye P.C.

(57) ABSTRACT

A control unit for controlling fuel pressure in a common rail comprises a pressure sensor for detecting fuel pressure in the common rail, a decreased amount presuming means for calculating a presumed decreased amount (PC1) of the common rail fuel pressure, and a first determination means for comparing the detected decreased amount (PC2) of the common rail fuel pressure with the presumed decreased amount (PC1), in order to determine whether any abnormal condition is in the outputs from the pressure sensor. Therefore, the malfunction of the pressure sensor or any abnormal conditions included in the outputs from the pressure sensor can be detected even during the engine operation.

9 Claims, 6 Drawing Sheets

COMMON RAIL FUEL INJECTION SYSTEM

CROSS REFERENCE TO RELATED APPLICATION

This application is based on Japanese Patent Application No. 2004-264246, which is filed on Sep. 10, 2004, the disclosure of which is incorporated herein by reference.

FIELD OF THE INVENTION

The present invention relates to a common rail fuel injection system, and more particularly to a detection system for detecting a malfunction of a pressure sensor or an abnormal output from the pressure sensor for a common rail pressure (fuel pressure) in a common rail.

BACKGROUND OF THE INVENTION

In a common rail fuel injection system for an internal combustion engine, a discharge fuel amount of a high pressure pump is controlled, in such a manner that a detected pressure "PCi" of a common rail fuel pressure detected by a pressure sensor becomes equal to a target pressure "PC0" for the common rail fuel pressure, which is decided depending on operational conditions of the engine.

In the case that the detected pressure "PCi" of the common rail fuel pressure inputted into an electronic control unit (ECU) is changed due to any reason (for example, a malfunction of an amplifier, which amplifies the detected signal and supplies the amplified signal to the ECU), such an abnormal detected pressure "PCi" is controlled to coincide with the target pressure "PC0". As a result, a defect may occur, in which an actual fuel injection amount "Qi" injected from an injector may deviate from a target fuel injection amount "Q0".

The defect caused by the abnormal outputs from the fuel pressure sensor is explained with reference to FIG. 6A.

When the common rail fuel pressure sensor is operating in order, namely its output (the detected fuel pressure "PCi") is in a normal condition, the output from the pressure sensor varies in line with a line A in FIG. 6A.

In the case that the output (the detected fuel pressure "PCi") from the common rail fuel pressure sensor becomes abnormal, the output would become higher than that in the normal operation, as indicted by a line B in FIG. 6A, or the output would become lower than that in the normal operation, as indicted by a line C in FIG. 6A.

In the case that the output from the common rail fuel pressure sensor is higher than that in the normal condition, as shown by the line B in FIG. 6A, a discharge amount of the high pressure pump is controlled in such a way that the detected common rail fuel pressure "PCi" may become equal to the target common rail fuel pressure "PC0". As a result, a defect may occur, in which the actual fuel injection amount "Qi" injected from the injector would become smaller than the target fuel injection amount "Q0", since the actual common rail fuel pressure "JP" would become lower than the target common rail fuel pressure "PC0".

On the other hand, in the case that the output from the common rail fuel pressure sensor is lower than that in the normal condition, as shown by the line C in FIG. 6A, the discharge amount of the high pressure pump is likewise controlled in such a way that the detected common rail fuel pressure "PCi" may become equal to the target common rail fuel pressure "PC0". As a result, a defect may occur, in which the actual fuel injection amount "Qi" injected from the injector would become larger than the target fuel injection amount "Q0", since the actual common rail fuel pressure "JP" would become higher than the target common rail fuel pressure "PC0".

In one of prior arts, for example, Japanese Patent Publication No. 2003-222045, a common rail fuel pressure "PCi" is detected at a re-starting of an engine, after a certain time period has passed since a stop of engine operation. And it is determined whether the common rail fuel pressure "PCi" detected before a high pressure pump starts its operation is within a predetermined ambient pressure range, in order to detect a possible malfunction of the common rail fuel pressure sensor. This technology is based on an assumption that an actual common rail pressure "JP" would be decreased to the ambient pressure, after the certain time period has passed since the stop of engine operation.

The above detection for the malfunction of the common rail fuel pressure sensor (including an abnormal condition in the outputs from the pressure sensor) can be done, however, only when the common rail fuel pressure is around the ambient pressure (low pressure side). It is not possible in the above detection process to detect the malfunction of the common rail fuel pressure sensor, when the common rail pressure is at a high pressure side.

Furthermore, the above detection process must be performed during the engine operation is stopped (i.e. before the high pressure pump starts its operation).

Accordingly, it is not possible in the above detection process to detect the malfunction of the common rail fuel pressure sensor during the engine is operating.

In particular, in recent years, a catalyst (such as DPF) has been provided in a motor vehicle to further improve purification of exhaust gas. It may cause damages to the catalyst (e.g. a crack in the catalyst due to an excessively increased high temperature, a decrease of catalytic effect due to shortage of fuel supply), in the case that the actual fuel injection amount "Qi" is abnormally deviated from the target fuel injection amount "Q0". It is, therefore, necessary to detect the malfunction of the common rail fuel pressure sensor as early as possible, so that the abnormal condition for the actual fuel injection amount "Qi" can be dealt with at an earlier stage. For this purpose, it is desired to detect the malfunction of the common rail fuel pressure sensor, even during the engine operation in which the common rail pressure is at the high pressure side.

SUMMARY OF THE INVENTION

The present invention is made in view of the above problems. It is, therefore, an object of the present invention to provide a common rail fuel injection system for an internal combustion engine, according to which it is possible to detect a malfunction of a common rail fuel pressure sensor (including an abnormal condition of outputs from the pressure sensor), even during the engine operation in which the common rail pressure is at the high pressure side.

According to a feature of the present invention, a control unit for controlling fuel pressure in a common rail comprises a pressure sensor for detecting fuel pressure in the common rail, a decreased amount presuming means for calculating a presumed decreased amount of the common rail fuel pressure, and a first determination means for comparing the detected decreased amount of the common rail fuel pressure with the presumed decreased amount, in order to determine whether any abnormal condition is in the outputs from the pressure sensor.

Therefore, the malfunction of the pressure sensor or any abnormal conditions included in the outputs from the pressure sensor can be detected even during the engine operation.

According to another feature of the present invention, the detected decreased amount of the common rail fuel pressure is compared with a predetermined normal range of the presumed decreased amount, and the abnormal condition can be detected when the detected decreased amount is smaller or larger than the predetermined normal range of the presumed decreased amount.

Therefore, the abnormal conditions of "shortage of fuel injection" and "excess of fuel injection" can be detected even during a period in which the engine is operating, namely the fuel injection system is operating with high fuel pressure.

According to a further feature of the present invention, a combustion result detecting sensor (for example, an exhaust gas temperature sensor) is provided in the fuel injection system. The control unit of the fuel injection system further comprises a combustion result presuming means for calculating a presumed value (e.g. a presumed exhaust gas temperature) representing a combustion result in the engine, based on the fuel injection amount. And a second determination means compares the detected value (e.g. a detected exhaust gas temperature) of the combustion result detecting sensor with the presumed value (e.g. the presumed exhaust gas temperature), in order to determine whether any abnormal condition is in the fuel injection amount.

The control unit of the fuel injection system further comprises a total determination means, which identifies a portion in which the abnormal condition occurs, based on the determinations of the first and second determination means.

As a result, the total determination means can determine that the abnormal condition ("shortage of fuel injection" or "excess of fuel injection") has occurred in the pressure sensor, or can determine that a fuel leakage has occurred somewhere other than the normal fuel injection.

BRIEF DESCRIPTION OF THE DRAWINGS

The above and other objects, features and advantages of the present invention will become more apparent from the following detailed description made with reference to the accompanying drawings. In the drawings.

Figure 1:
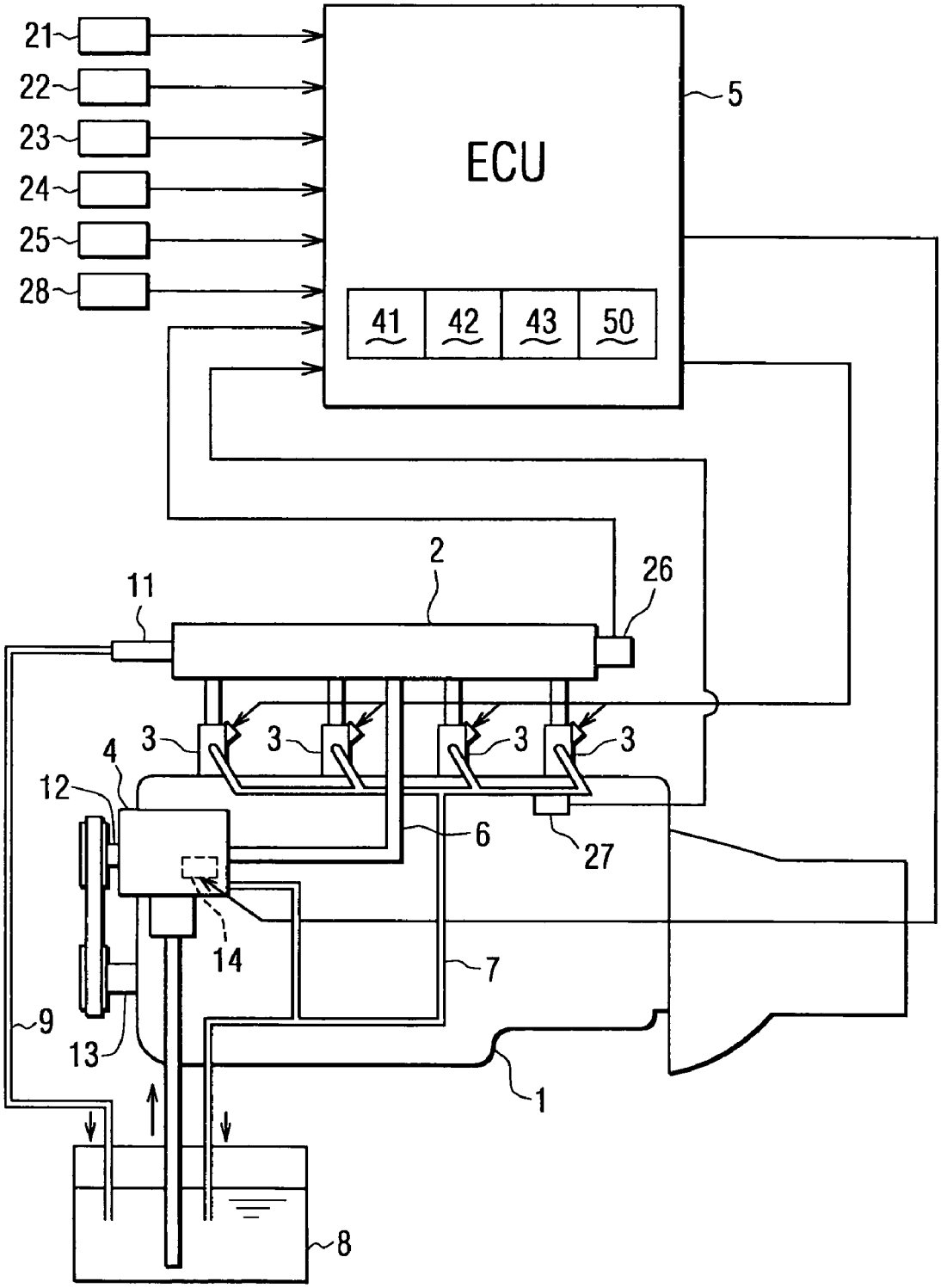
FIG. 1 is a schematic view showing a common rail fuel injection system for an internal combustion engine according to a first embodiment of the present invention.

DETAILED DESCRIPTION OF THE PREFERRED EMBODIMENTS (First Embodiment)

An embodiment of a common rail fuel injection system, to which the present invention is applied, is explained with reference to FIGS. 1 to 6. At first, a basic structure of the common rail fuel injection system is explained with reference to FIGS. 1 and 2.

The common rail fuel injection system is a system for injecting fuel to a diesel engine 1, which comprises a common rail 2, multiple injectors 3, a supply pump 4, an electronic control unit 5 (hereinafter also referred to as ECU) and so on.

The engine 1 has multiple cylinders and operates in four cycles of a suction stroke, a compression stroke, an explosion stroke and an exhaust stroke. The engine 1 of FIG. 1 is shown as a 4 cylinder engine, as an example. Any other type of the engine, having a different number of cylinders, can be also used.

The common rail 2 is an accumulating container (rail) for accumulating high pressure fuel to be supplied to the injectors 3. The common rail 2 is connected to the supply pump 4 through a fuel line 6 (a high pressure fuel pipe), so that high pressure fuel of a common rail pressure, which corresponds to a fuel injection pressure, can be accumulated.

A leak fuel from the injectors 3 returns to a fuel tank 8 via a leak line 7 (a fuel return pipe).

A pressure limiter 11 is provided in a fuel relief line 9 (a fuel return pipe) connected between the common rail 2 and the fuel tank 8. The pressure limiter 11 is a pressure safety valve, a vale of which is opened when the fuel pressure in the common rail 2 exceeds an upper limit preset pressure, so that the fuel pressure can be maintained at a pressure lower than the upper limit preset pressure.

The injectors 3 are mounted to the respective cylinders of the engine 1, to inject fuel into the cylinders. The injectors 3 are provided at downstream sides of multiple high pressure fuel lines, which are branched off from the common rail 2, so that the injectors inject the high pressure fuel accumulated in the common rail 2 into the respective cylinders. The detailed structure of the injector 3 is further explained later.

The supply pump 4 comprises a feed pump for sucking the fuel from the fuel tank 8 to the supply pump 4, and a high pressure pump for pressurizing the sucked fuel from the fuel tank 8 and pumping out the pressurized high pressure fuel to the common rail 2. The feed pump as well as the high pressure pump is operated by a common cam shaft 12, which is driven to rotate by a crank shaft 13 of the engine 1, as shown in FIG. 1.

The supply pump 4 further comprises a pump control valve 14 (hereinafter also referred to as a suction control valve (SCV)), for adjusting fuel amount to be sucked into the high pressure pump, wherein the fuel pressure in the common rail 2 is controlled by adjusting the fuel amount with the SCV 14 operated by the ECU 5.

(Detailed Structure of the Injector 3)

Figure 2:
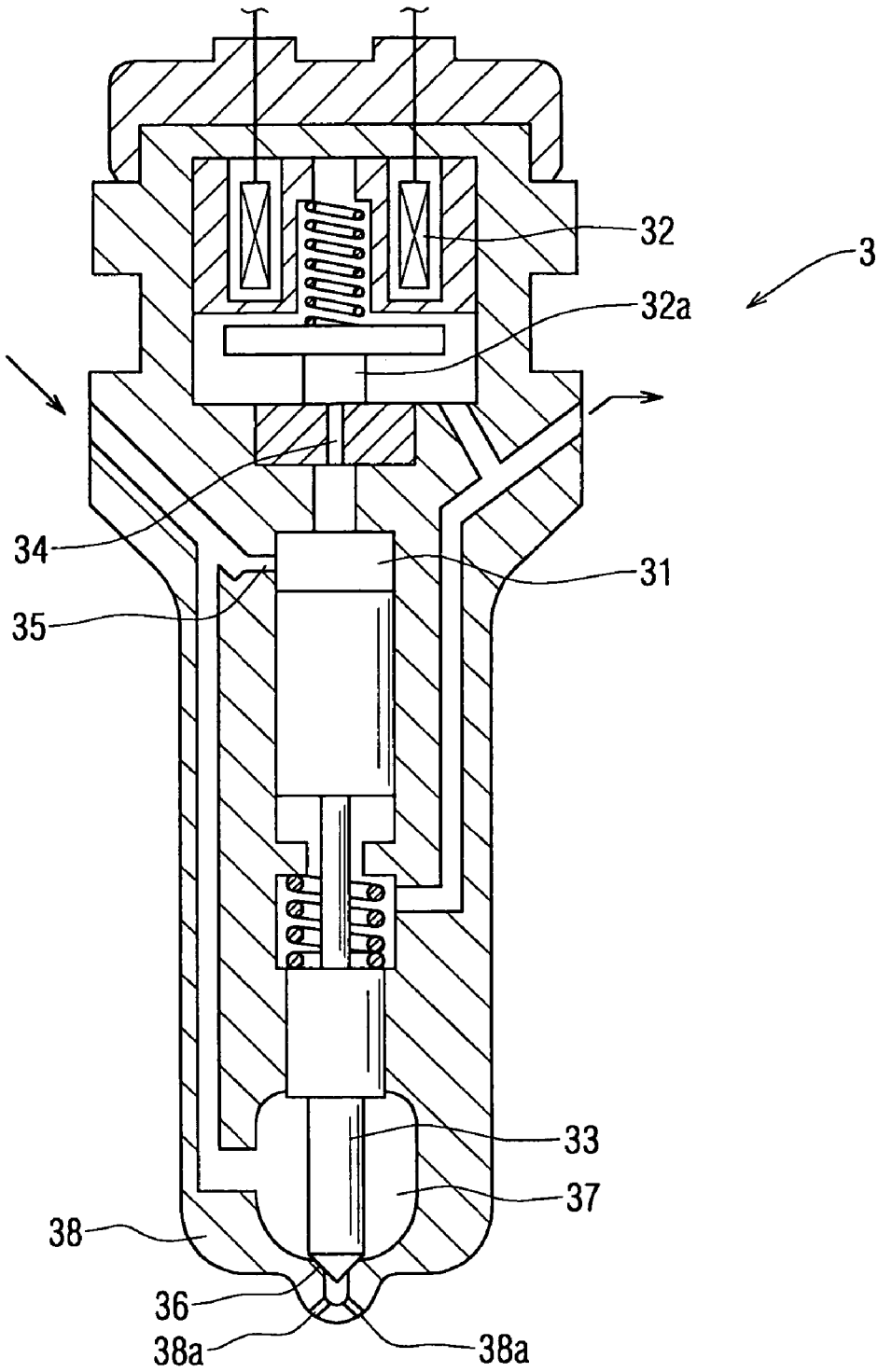
FIG. 2 is a schematic cross sectional view showing an injector.

The structure and operation of the injector 3 are explained with reference to FIG. 2.

The injector 3 is of a two-valve type, in which a needle 33 is operated by controlling fuel pressure in a pressure control chamber 31 (a back pressure chamber) by means of an electromagnetic valve 32. When a command signal (ON signal) for the fuel injection is supplied from the ECU 5 to the electromagnetic valve 32, a valve element 32*a* of the electromagnetic valve 32 is lifted up, and at the same time an outlet orifice 34 is opened, so that the fuel pressure in the pressure control chamber 31 is decreased. The high pressure fuel is supplied into the pressure control chamber 31 from the common rail 2 through an inlet orifice 35. However, since an inner diameter of the outlet orifice 34 is larger than that of the inlet orifice 35, the fuel pressure in the pressure control chamber 31 will be decreased, as mentioned above, when the outlet orifice is opened.

When the fuel pressure in the pressure control chamber 31 is decreased to such a value lower than a valve opening pressure, the needle 33 starts the upward movement. When the needle 33 is separated from a nozzle seat 36, a nozzle chamber 37 becomes in communication with fuel injection ports 38*a* formed in a nozzle body 38, so that high pressure fuel supplied into the nozzle chamber 37 will be injected from the fuel injection ports 38*a*. As the needle is lifted up, fuel injection rate is increased.

When the command signal (ON signal) for the fuel injection supplied from the ECU 5 is terminated (namely, an OFF signal is supplied), the valve element 32*a* of the electromagnetic valve 32 starts its downward movement. When the outlet orifice 34 is closed by the valve element 32*a*, the fuel pressure in the pressure control chamber 31 is increased. When the fuel pressure in the pressure control chamber 31 is increased to such a value higher than a valve closing pressure, the needle 33 starts the downward movement. When the needle 33 becomes seated on the nozzle seat 36, the communication between the nozzle chamber 37 and the fuel injection ports 38*a* is cut off, to stop the fuel injection from the fuel injection ports 38*a*.

(Structure of ECU)

The ECU 5 is formed by a well known microcomputer which comprises a CPU for performing a control process and a calculating process, a memory device (memories, such as a ROM, a stand-by RAM, an EEPROM, a RAM, etc.), an input circuit, an output circuit, a power supply circuit, and so on. In this embodiment, an electric drive unit (EDU) is integrally formed in the ECU 5. However, the EDU can be provided independently from the ECU 5. The EDU comprises an injector drive circuit for driving the injectors 3, and an SCV drive circuit for driving the SCV 14 of the supply pump 4.

The ECU 5 performs various kinds of calculation processes based on inputted signals from sensors (those are signals for engine parameters representing operating conditions of the engine 1, including a driving condition of a vehicle driver).

Connected to the ECU 5 are an acceleration sensor 21 for detecting an opening degree of a throttle valve operated by an acceleration pedal, a rotational speed sensor 22 for detecting an engine rotational speed and a crank angle, an intake air temperature sensor 23 for detecting a temperature (ambient temperature) of fresh air taken into the engine 1, an air flow meter 24 for detecting an amount of the intake air, an exhaust gas temperature sensor 25 for detecting a temperature of exhaust gas from the engine 1, a common rail fuel pressure sensor 26 for detecting fuel pressure in the common rail 2, a fuel temperature sensor 27 for detecting a temperature of the fuel to be supplied to the injectors 3, and another sensor 28 for detecting another operational condition of the engine 1.

The ECU 5 performs a driving control (fuel injection control) for the injectors 3 as well as a driving control (an opening degree control) for the SCV 14 of the supply pump 4, for each fuel injection, based on a program (a map, a calculation formula, etc.) memorized in the ROM and the engine parameters read into the RAM.

The ECU 5 comprises a calculating means 41 for a target fuel injection amount and another calculating means 42 for a target fuel injection timing, as the control program for driving the injectors 3.

The ECU 5 further comprises a calculating means 43 for a target fuel pressure as the control program for driving the SCV 14 (the control program for controlling a discharge pressure of the supply pump 4).

The calculating means 41 for the target fuel injection amount is a control program, according to which the ECU 5 calculates a target fuel injection amount "Q0" corresponding to the current operational condition, calculates an injector driving time for achieving the target fuel injection amount "Q0", and generates a fuel injection signal for effecting the fuel injection during the above injector driving time (which is a time period of an ON signal for the fuel injection).

The calculating means 42 for the target fuel injection timing is a control program, according to which the ECU 5 calculates a basic injection timing "T" for starting an ignition of the fuel at an ideal ignition timing (an expected target ignition timing) depending on the current operational condition, calculates an injection command timing for starting the fuel injection at the above basic injection timing "T", and generates an injection start signal (an ON signal for the fuel injection) at the injection command timing to the injector drive circuit.

The calculating means 43 for the target fuel pressure comprises a calculating means for calculating a target common rail fuel pressure "PC0" (fuel supply pressure of the common rail) depending on the current operational condition, and a pressure control means for calculating an opening degree of the SCV 14 with which a detected common rail pressure "PCi" by the common rail fuel pressure sensor 26 is controlled to become equal to (or close to) the above target common rail fuel pressure "PC0". Then, the calculating means 43 for the target fuel pressure generates a valve opening signal (e.g. PWM signal) to the SCV drive circuit, so that the opening degree calculated by the pressure control means can be actually obtained in the SCV 14.

(Features of First Embodiment)

The ECU 5 further comprises a malfunction detecting means 50 for detecting whether or not any malfunction occurs in the common rail fuel pressure sensor 26 during an operation of the engine 1. The structure for this malfunction detection is explained with reference to FIGS. 3 to 6.

Figure 3:
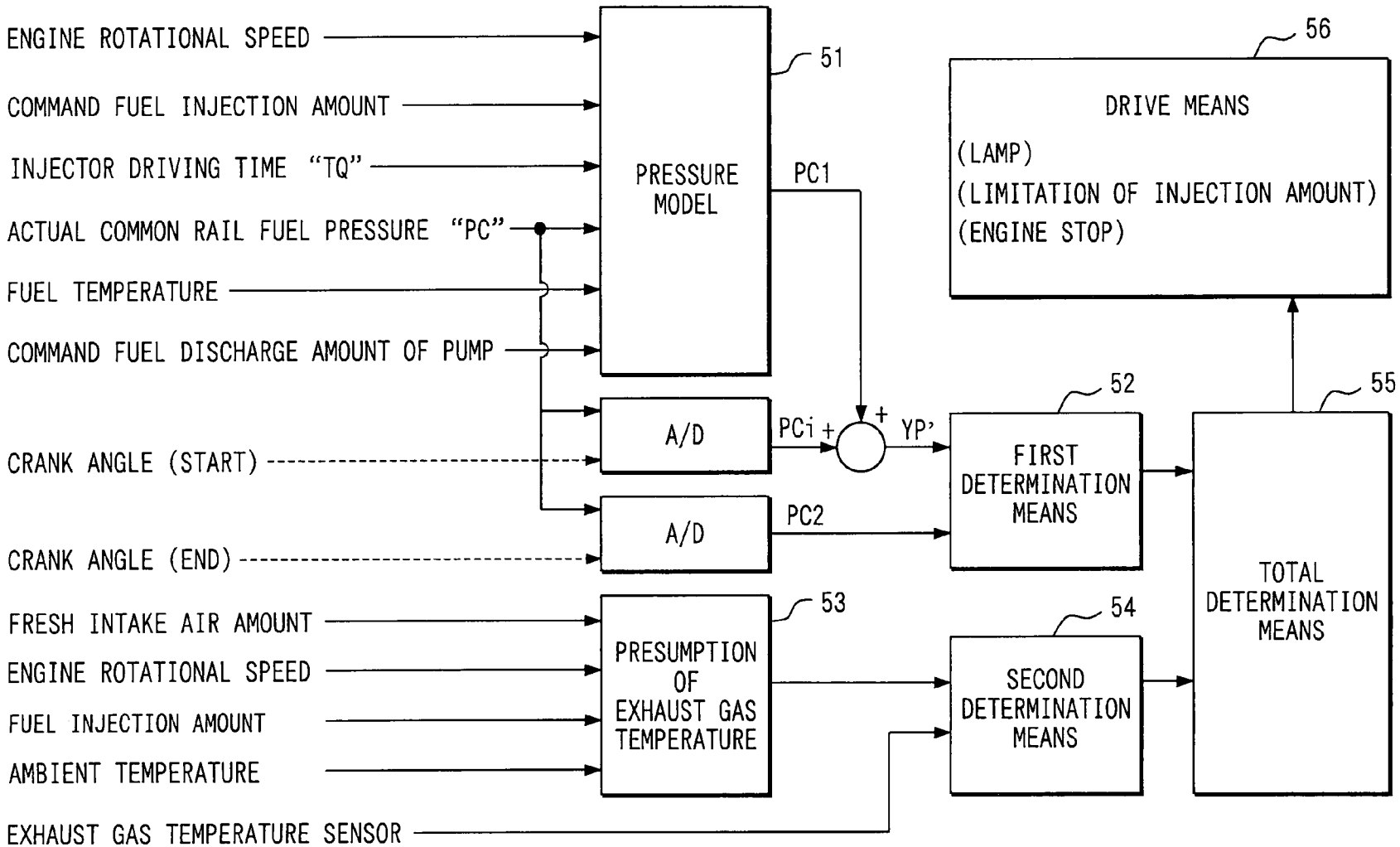
FIG. 3 is a block diagram showing a flow for detecting a malfunction of a common rail fuel pressure sensor.

The malfunction detecting means 50 comprises a decreased amount presuming means 51 (which corresponds to a pressure model in FIG. 3), a first determination means 52, a combustion result presuming means 53 (which corresponds to a presumption of exhaust gas temperature in FIG. 3), a second determination means 54, a total determination means 55, and a drive means 56.

(The Decreased Amount Presuming Means 51)

The decreased amount presuming means 51 is a program for calculating a presumed decreased amount "PC1" of the common rail pressure, which takes place as a result of fuel injections by the injectors 3.

The decreased amount of the common rail pressure caused by the fuel injection at the injectors 3 changes depending on the target injection amount "Q0", the injector driving time, the target common rail fuel pressure "PC0", the engine rotational speed, the cam angle of the supply pump 4, and the fuel temperature. The decreased amount presuming means 51 calculates the presumed decreased amount "PC1" of the common rail pressure, based on the above respective values within a predetermined crank angle range.

The predetermined crank angle range is a range of the crank angle during which the fuel injection is performed at the injector 3, namely it is a part of the crank angle range from BTDC30° C.A to ATDC60° C.A (BTDC=before top dead center, ATDC=after top dead center, CA=crank angle).

(The First Determination Means 52)

The first determination means 52 is a program for determining whether or not a malfunction occurs in the common rail fuel pressure sensor 26, based on a difference pressure "ΔPC" between the detected decreased amount "PC2" detected by the common rail fuel pressure sensor 26 and the presumed decreased amount "PC1" calculated by the decreased amount presuming means 51.

Two examples of calculating the difference pressure "ΔPC" are explained.

(First Example by Direct Comparison)

The decreased amount "PC2" is calculated by subtracting the minimum value among the detected decreased amounts "PCi" in the predetermined crank angle range (during which the fuel injection is performed at the injector 3) from the detected decreased amounts "PCi" read into the ECU 5 by the common rail fuel pressure sensor 26 at a time shortly before the fuel injection (or at the start of the fuel injection). The difference pressure "ΔPC" is calculated by subtracting the presumed decreased amount "PC1" calculated by the decreased amount presuming means 51 from the decreased amount "PC2" obtained as above.

(Second Example by Indirect Comparison: Example Shown in FIG. 3)

The minimum value among the detected decreased amounts "PCi" in the predetermined crank angle range, during which the fuel injection is performed at the injector 3, is read at first. Then a presumed minimum value "YP'" of the decreased amount is calculated by subtracting the presumed decreased amount "PC1" from the detected common rail fuel pressure at the time shortly before the fuel injection (or at the start of the fuel injection). The difference pressure "ΔPC" is calculated by subtracting the presumed minimum value "YP'" of the decreased amount from the minimum value "PCi" the detected decreased amount.

Figure 6A:
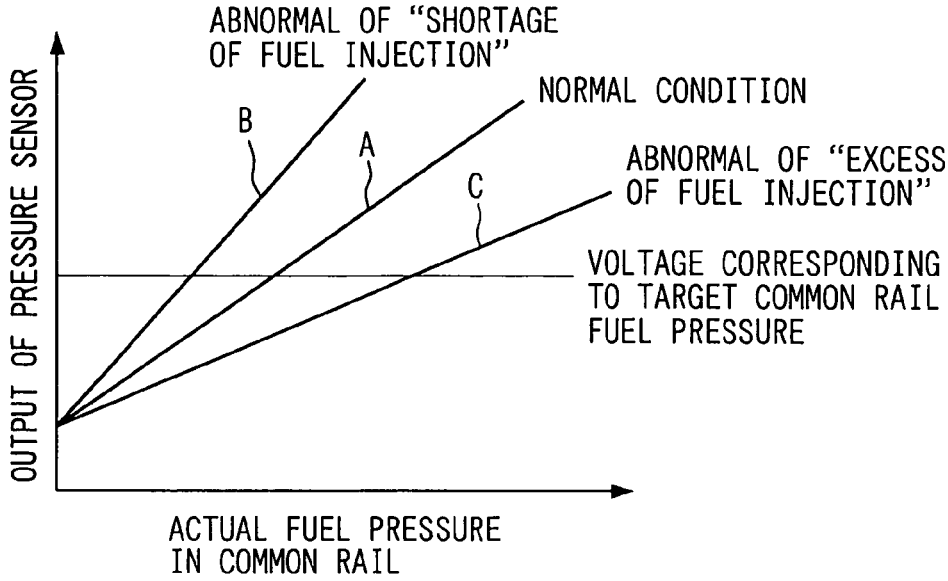
FIG. 6A is a graph showing a relation between a detected common rail fuel pressure and an actual common rail fuel pressure.

When the common rail fuel pressure sensor 26 is operating in order, namely its output (the detected fuel pressure "PCi") is in a normal condition, the output corresponds to a line A in FIG. 6A.

In the case that the output from the common rail fuel pressure sensor 26 becomes abnormal, the output would become higher than the normal operation, as indicted by a line B in FIG. 6A, or the output would become lower than the normal operation, as indicted by a line C in FIG. 6A.

In the case that the output from the common rail fuel pressure sensor 26 is in the normal condition, as shown by the line A in FIG. 6A, an actual fuel injection amount "Qi" injected from the injector 3 coincides with the target fuel injection amount "Q0", since an actual common rail fuel pressure "JP" coincides with the target common rail fuel pressure "PC0".

Figure 6B:
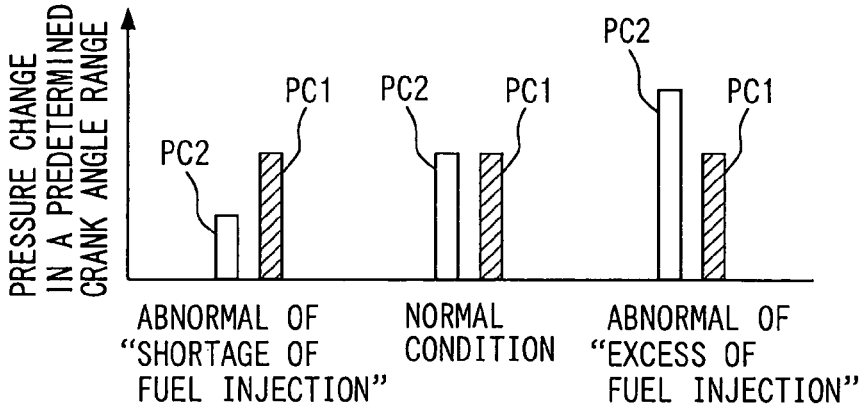
FIG. 6B is a graph showing comparisons between a detected decreased amount "PC2" and a presumed decreased amount "PC1" of common rail fuel pressure.
Figure 6C:
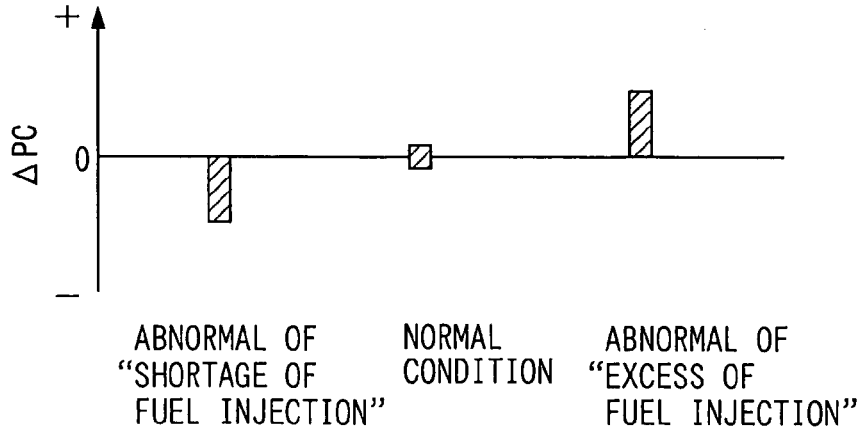
FIG. 6C is a graph showing values of "ΔPC" in respective cases.

As a result, the detected decreased amount "PC2" becomes substantially equal to the presumed decreased amount "PC 1", as shown in a middle portion of FIG. 6B, and thereby the difference pressure "ΔPC" calculated by subtracting the presumed decreased amount "PC" from the detected decreased amount "PC2" becomes almost zero, as shown in a middle portion of FIG. 6C.

In the case that the output from the common rail fuel pressure sensor 26 is higher than that in the normal condition, as shown by the line B in FIG. 6A, a discharge amount of the high pressure pump is controlled in such a way that the detected common rail fuel pressure "PCi" may become equal or close to the target common rail fuel pressure "PC0". As a result, a defect may occur, in which the actual fuel injection amount "Qi" injected from the injector 3 would become smaller than the target fuel injection amount "Q0", since the actual common rail fuel pressure "JP" would become lower than the target common rail fuel pressure "PC0".

Accordingly, the detected decreased amount "PC2" becomes smaller than the presumed decreased amount "PC1", as shown in a left hand portion of FIG. 6B, and thereby the difference pressure "ΔPC" calculated by subtracting the presumed decreased amount "PC1" from the detected decreased amount "PC2" becomes larger in a negative direction, as shown in the left hand portion of FIG. 6C.

On the other hand, in the case that the output from the common rail fuel pressure sensor 26 is lower than that in the normal condition, as shown by the line C in FIG. 6A, a discharge amount of the high pressure pump is likewise controlled in such a way that the detected common rail fuel pressure "PCi" may become equal or close to the target common rail fuel pressure "PC0". As a result, a defect may occur, in which the actual fuel injection amount "Qi" injected from the injector 3 would become larger than the target fuel injection amount "Q0", since the actual common rail fuel pressure "JP" would become higher than the target common rail fuel pressure "PC0".

Accordingly, the detected decreased amount "PC2" becomes larger than the presumed decreased amount "PC1", as shown in a right hand portion of FIG. 6B, and thereby the difference pressure "ΔPC" calculated by subtracting the presumed decreased amount "PC1" from the detected decreased amount "PC2" becomes larger in a positive direction, as shown in the right hand portion of FIG. 6C.

As above, it is possible to determine whether the output from the common rail fuel pressure sensor 26 is in the normal condition, whether the output from the common rail fuel pressure sensor 26 is higher than that in the normal condition, or whether the output from the common rail fuel pressure sensor 26 is lower than that in the normal condition, by using the difference pressure "ΔPC" calculated by subtracting the presumed decreased amount "PC1" from the detected decreased amount "PC2".

The first determination means 52 determines that the output from the common rail fuel pressure sensor 26 is in the abnormal condition of "a shortage of fuel injection", when the detected decreased amount "PC2" is smaller than a normal range (a threshold range) of the presumed decreased amount "PC1", namely when difference pressure "ΔPC" is in the negative side of the threshold range. In the similar manner, the first determination means 52 determines that the output from the common rail fuel pressure sensor 26 is in the abnormal condition of "an excess of fuel injection", when the detected decreased amount "PC2" is larger than the normal range (the threshold range) of the presumed decreased amount "PC1", namely when difference pressure "ΔPC" is in the positive side of the threshold range.

(The Combustion Result Presuming Means 53)

As already described above, the common rail fuel injection system has the exhaust gas temperature sensor 25 for detecting the temperature of the exhaust gas of the engine 1, which is an example for a combustion result detecting means for detecting the result of the combustion in the engine 1 effected by the fuel injection by the injectors 3.

The combustion result presuming means 53 is a program for calculating a presumed exhaust gas temperature "TG1" of the exhaust gas emitted from the engine 1, based on the fuel injection amount of the injectors 3.

The exhaust gas temperature can be presumed from the fuel injection amount injected from the injector 3, the fresh intake air amount sucked into the engine 1 (which varies depending on an EGR amount (an exhaust gas recirculation amount)), and the temperature of the fresh intake air.

An example for calculating the presumed exhaust gas temperature "TG1" by the combustion result presuming means 53 is explained with reference to FIG. 4.

The ECU 5 has, as a means for calculating the presumed exhaust gas temperature "TG1", a basic temperature presuming means 61, an intake air amount correcting means 62 and an intake air temperature correcting means 63.

Figure 4:
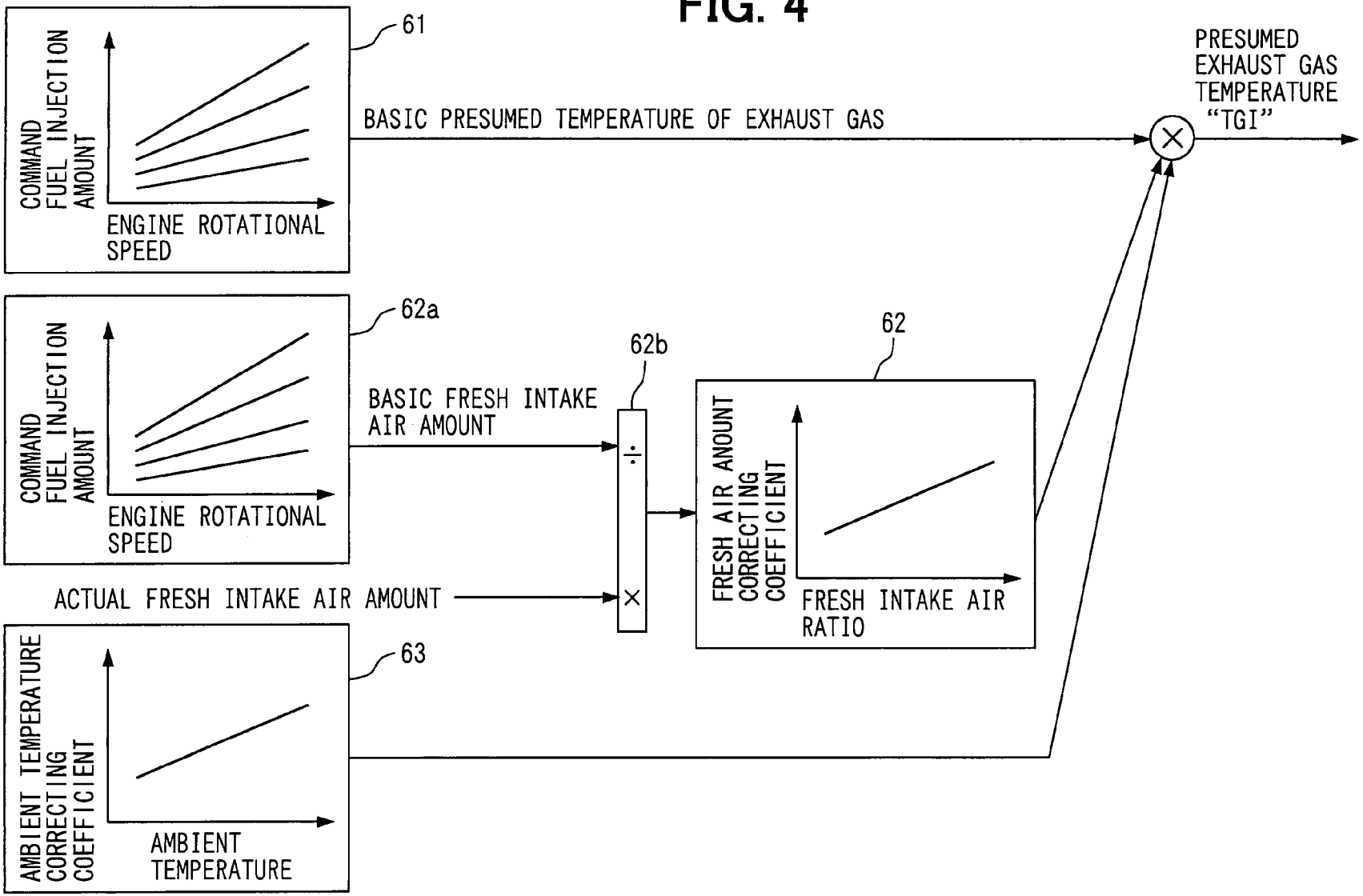
FIG. 4 is an explanatory chart for presuming exhaust gas temperature.

The basic temperature presuming means 61 is a program for calculating a basic presumed temperature of the exhaust gas, as shown in an upper part of FIG. 4, based on a map indicating a relation between the target fuel injection amount "Q0" (which corresponds to a command fuel injection amount in FIG. 4) and the engine rotational speed, and also based on calculating formulas.

As shown in a middle part of FIG. 4, the intake air amount correcting means 62 has a basic intake air amount calculating means 62*a*, which calculates a basic fresh intake air amount based on a map indicating a relation between the target fuel injection amount "Q0" (which corresponds to a command fuel injection amount in FIG. 4) and the engine rotational speed, and also based on calculating formulas. The intake air amount correcting means 62 further has an intake air ratio calculating means 62*b*, which calculates a fresh intake air ratio (which is a ratio of the fresh air contained in the intake air to be sucked into the respective cylinders) by comparing the basic fresh intake air amount calculated by the above basic intake air amount calculating means 62*a* with the actual intake air amount detected by the air flow meter 24. The intake air amount correcting means 62 is a program for calculating a fresh air amount correcting coefficient, based on a map and formulas from the intake fresh air ratio.

The intake air temperature correcting means 63 is a program for calculating an ambient temperature correcting coefficient, based on a map and formulas from the temperature of the fresh intake air detected by the intake air temperature sensor 23.

The combustion result presuming means 53 calculates the presumed exhaust gas temperature "TG1", by correcting the basic presumed temperature of the exhaust gas calculated by the basic temperature presuming means 61 with the fresh air amount correcting coefficient calculated by the intake air amount correcting means 62 and with the ambient temperature correcting coefficient calculated by the intake air temperature correcting means 63.

(The Second Determination Means 54)

The second determination means 54 is a program for determining whether or not the fuel injection amount is in the normal condition, based on a difference "ΔTG" between the detected exhaust gas temperature "TGi" detected by the exhaust gas temperature sensor 25 and the presumed exhaust gas temperature "TG1" calculated by the combustion result presuming means 53.

The combustion result presuming means 53 and the second determination means 54 are controlled to start their operation, in the case that the first determination means 52 determines that the output from the common rail fuel pressure sensor 26 is in the abnormal condition of "the excess of fuel injection".

The second determination means 54 determines that the fuel injection is in the normal condition, when the difference "ΔTG" between the detected exhaust gas temperature "TGi" and the presumed exhaust gas temperature "TG1" is in a normal operating range (within a threshold range). However, the second determination means 54 determines that the fuel injection is in the abnormal condition of "the excess of fuel injection", when the detected exhaust gas temperature "TGi" is higher than normal operating range (the threshold range) of the presumed exhaust gas temperature "TG1".

Figure 5:
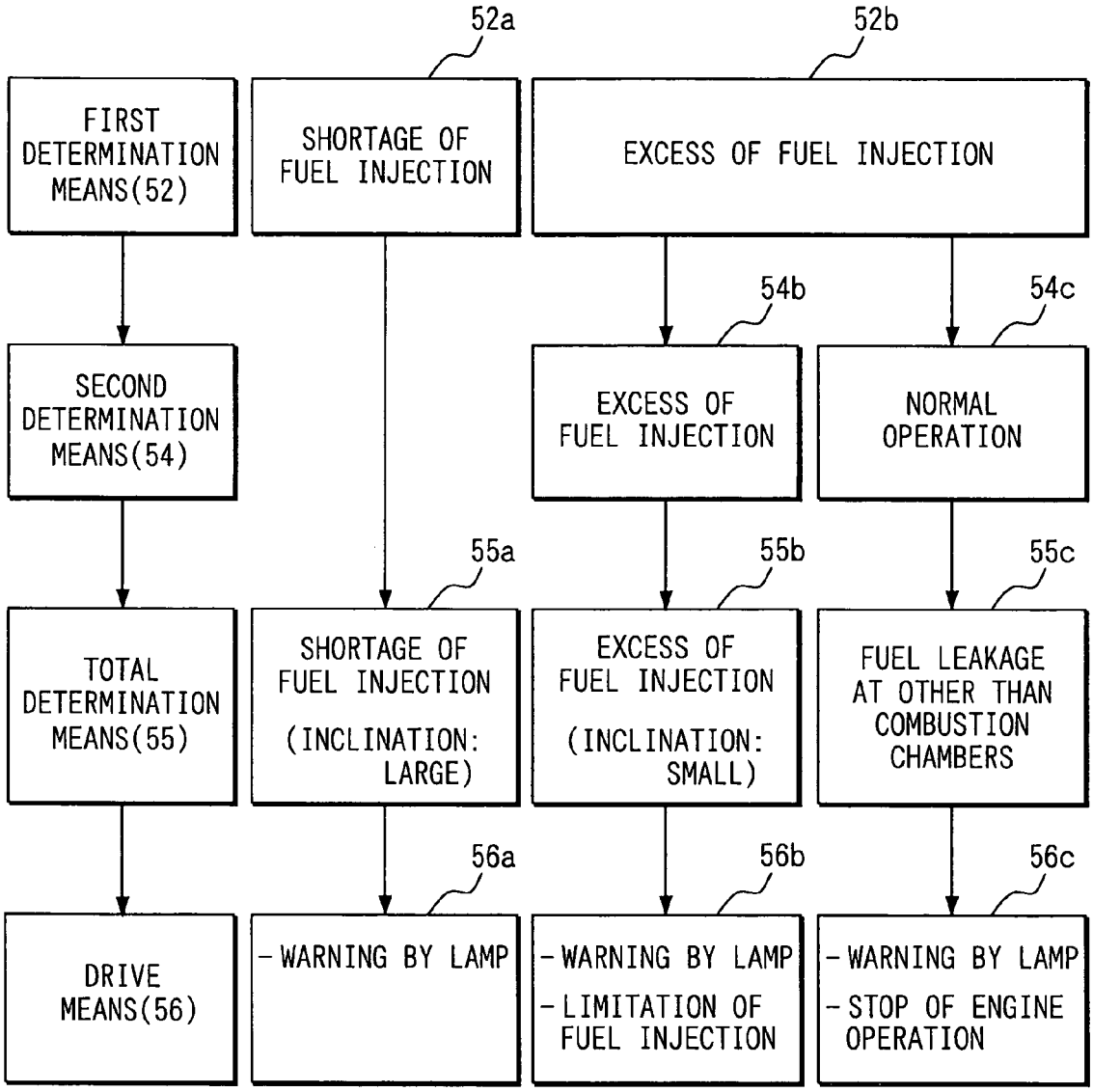
FIG. 5 is a chart showing results of determination and actions to be taken, when the malfunction is detected.

The total determination means 55 is a program for identifying an abnormal operation (a portion in which the abnormal operation occurs), based on and/or by comparing the determinations at the first and second determination means 52 and 54. The total determination means 55 outputs a control signal to a drive means 56, in which a step is performed corresponding to the identified abnormal operation, as shown in FIG. 5.

(In Case of "the Shortage of Fuel Injection" Determined by the First Determination Means 52)

The operation of the total determination means 55 is further explained with reference to FIG. 5.

As already explained above, the first determination means 52 determines that the output from the common rail fuel pressure sensor 26 is in the abnormal condition of "the shortage of fuel injection" (52*a* in FIG. 5), when the detected decreased amount "PC2" is smaller than the normal range (the threshold range) of the presumed decreased amount "PC1" (i.e. when the difference "ΔPC" is in the negative side of the threshold range). In this case, the total determination means 55 also determines "the shortage of fuel injection" (55*a* in FIG. 5) due to a malfunction of the common rail fuel pressure sensor 26, and indicates "the malfunction by the shortage of fuel injection" (56*a* in FIG. 5) to a vehicle driver by a display means (not shown), such as a lamp.

(In Case of "the Excess of Fuel Injection" Determined by the First and Second Determination Means 52 and 54)

The first determination means 52 determines that the output from the common rail fuel pressure sensor 26 is in the abnormal condition of "the excess of fuel injection" (52*b* in FIG. 5), when the detected decreased amount "PC2" is larger than the normal range (the threshold range) of the presumed decreased amount "PC1" (i.e. when the difference "ΔPC" is in the positive side of the threshold range). Then, the second determination means 54 starts its operation and determines that the fuel injection is in the abnormal condition of "the excess of fuel injection" (54*b* in FIG. 5), when the detected exhaust gas temperature "TGi" is higher than normal operating range (the threshold range) of the presumed exhaust gas temperature "TG1".

In the case that both of the first and second determination means 52 and 54 determine "the excess of fuel injection", the actual fuel injection amount "Qi" is controlled to be higher than the target fuel injection amount "Q0". Therefore, the total determination means 55 also determines "the excess of fuel injection" (55*b* in FIG. 5) due to a malfunction of the common rail fuel pressure sensor 26, and indicates "the malfunction by the excess of fuel injection" (56*b* in FIG. 5) to the vehicle driver by the display means, such as a lamp, and at the same time performs a control for applying a further limitation to an upper limit of the target fuel injection amount "Q0" (56*b* in FIG. 5).

(In Case of "the Excess of Fuel Injection" Determined by the First Determination Means 52, and "the Normal Condition" by the Second Determination Means 54)

As in the similar manner to the above operation, the first determination means 52 determines that the output from the common rail fuel pressure sensor 26 is in the abnormal condition of "the excess of fuel injection" (52*b* in FIG. 5), when the detected decreased amount "PC2" is larger than the normal range (the threshold range) of the presumed decreased amount "PC1" (i.e. when the difference "ΔPC" is in the positive side of the threshold range). Then, the second determination means 54 starts its operation and determines that the fuel injection is in the normal condition (54*c* in FIG. 5), when the difference "ΔTG" between the detected exhaust gas temperature "TGi" and the presumed exhaust gas temperature "TG1" is in the normal operating range (within the threshold range).

In the case that the first determination means 52 determines "the excess of fuel injection", whereas the second determination means 54 determines "the normal condition", the high pressure fuel might have leaked out of the fuel injection system at such portions other than the combustion chambers of the engine cylinders (i.e. other than the normal fuel injection). Therefore, the total determination means 55 determines "fuel leakage at other than combustion chambers" (55*c* in FIG. 5). The total determination means 55 indicates "the fuel leakage at other than combustion chambers" (56*c* in FIG. 5) to the vehicle driver by the display means, and performs at once a safety control with respect to the possible leakage of the fuel, for example a control of stopping the operation of the engine 1 (56*c* in FIG. 5).

EFFECTS OF THE EMBODIMENT

According to the above explained embodiment, it becomes possible to always detect the malfunction of the common rail fuel pressure sensor 26 (the abnormal operation of the fuel injection) even during the engine operation. This is because the common rail fuel injection system of the embodiment detects (determines) the abnormal condition of the common rail fuel pressure sensor 26, by comparing the presumed decreased amount "PC1" caused by the fuel injection by the injectors 3 with the detected decreased amount "PC2" detected by the common rail fuel pressure sensor 26.

Accordingly, an appropriate control for a fail-safe operation, including a prevention of a possible damage to a catalyst, can be performed.

As explained above, the fuel injection system can not identify whether the malfunction might have been caused by the malfunction of the common rail fuel pressure sensor 26 or by the fuel leakage, only by the comparison of the presumed decreased amount "PC1" and the detected decreased amount "PC2".

According to the above embodiment, however, the fuel injection system can correctly identify whether the malfunction might have been caused by the malfunction of the common rail fuel pressure sensor 26 or by the fuel leakage, by comparing the detected exhaust gas temperature "TGi" with the presumed exhaust gas temperature "TG1".

Accordingly, a more appropriate control for the fail-safe operation can be possible.

MODIFICATIONS

In the above embodiment, the exhaust gas temperature sensor 25 is used as one of the examples of the combustion result sensor for detecting the combustion result in the engine 1 by the fuel injection by the injectors 3, wherein the detected exhaust gas temperature "TGi" and the presumed exhaust gas temperature "TG1" are compared in order to differentiate the abnormal operation caused by the common rail fuel pressure sensor 26 and the abnormal operation caused by the fuel leakage.

However, any other types of sensor (such as, a pressure sensor for detecting a pressure inside the cylinders, an ionic current sensor for detecting the ionic current in the cylinders) than the exhaust gas temperature, can be used as the combustion result sensor. In such a case, a detected value of the sensor is compared with a presumed value of the sensor, to differentiate the abnormal conditions caused by the common rail fuel pressure sensor 26 or by the fuel leakage.

For example, in the case that the pressure sensor for detecting the pressure inside the cylinders is used, a detected peak cylinder pressure and a presumed peak cylinder pressure can be compared to identify the abnormal conditions caused by the common rail fuel pressure sensor 26 or by the fuel leakage.

Furthermore, in the above embodiment, the warning to the vehicle driver is done by the lamp, or the limitation to the fuel injection amount is further applied, when the abnormal condition in the outputs from the common rail fuel pressure sensor 26 is detected. However, the outputs of the pressure sensor 26 can be corrected by the ECU 5, based on the detected values in the abnormal condition, so that those outputs can be converted into such values which would be generally included in the normal operating range.

Furthermore, in the above embodiment, the detection for the possible abnormal condition for the common rail fuel pressure sensor 26 is continuously performed during the operation of the engine 1. However, such detection can be intermittently performed. For example, the detection for the possible abnormal condition can be carried out, when the operation of the engine 1 becomes to a stable operating condition, or can be carried out a predetermined interval.

Furthermore, the detection of the abnormal condition can be processed in such a manner that a certain number of those values which are used for determining the abnormal condition (for example, the detected decreased amount "PC2" of the common rail pressure) is taken as samples, an average value for those sampled data is calculated, and the determination of the abnormal condition is performed by use of such average value. In this case, the accuracy of the detection can be increased.

Furthermore, in the above embodiment, the injector 3 of the two-valve type having the electromagnetic valve 32 is used. However, an injector, in which a linear solenoid (or any other type of the injector, such as a piezoelectric actuator, an electromagnetic actuator, etc.) directly drives the needle 33, can be also used to the common rail fuel injection system of the present invention.

What is claimed is:

1. A common rail fuel injection system for an internal combustion engine comprising:

a high pressure pump for discharging high pressure fuel;

a common rail for accumulating the high pressure fuel supplied from the high pressure pump;

multiple injectors for injecting the high pressure fuel from the common rail into respective cylinders of the engine;

a pressure sensor for detecting common rail fuel pressure of the high pressure fuel accumulated in the common rail; and a control unit for controlling a discharge amount of the high pressure fuel to be discharged from the high pressure pump in order that a detected fuel pressure (PCi) detected by the pressure sensor will coincide with a target fuel pressure (PC0) calculated in accordance with operational conditions of the engine, and for controlling a fuel injection amount to be injected by the injector in order that an injected fuel amount will coincide with a target fuel injection amount calculated in accordance with the operational conditions of the engine, wherein the control unit comprises;

a decreased amount presuming means for calculating a presumed decreased amount (PC1) of the common rail fuel pressure, which occurs as a result of the fuel injection by the injectors;

a first determination means for directly or indirectly comparing a detected decreased amount (PC2) of the common rail fuel pressure detected by the pressure sensor with the presumed decreased amount (PC1), and for determining whether an abnormal condition is included in the outputs from the pressure sensor.

2. A common rail fuel injection system according to claim 1, wherein the first determination means determines an abnormal condition of "shortage of fuel injection", in the case that the detected decreased amount (PC2) is smaller than a predetermined normal range of the presumed decreased amount (PC1), and the first determination means determines an abnormal condition of "excess of fuel injection", in the case that the detected decreased amount (PC2) is larger than the predetermined normal range of the presumed decreased amount (PC1).

3. A common rail fuel injection system according to claim 1, further comprising:

a combustion result detecting sensor for detecting combustion result in the engine by the fuel injection from the injectors, wherein the control unit further comprises;

a combustion result presuming means for calculating a presumed value representing combustion result, based on the fuel injection amount from the injectors;

a second determination means for directly or indirectly comparing a detected value representing the combustion result detected by the combustion result detecting sensor with the presumed value calculated by the combustion result presuming means, and for determining whether an abnormal condition occurs in the fuel injection amount; and a total determination means for identifying a portion in which the abnormal condition occurs, based on the determinations of the first and second determination means.

4. A common rail fuel injection system according to claim 1, further comprising:

an exhaust gas temperature sensor for detecting exhaust gas temperature (TGi) of the exhaust gas emitted from the engine, wherein the control unit further comprises;

a combustion result presuming means for calculating a presumed exhaust gas temperature (TG1), based on the fuel injection amount from the injectors;

a second determination means for directly or indirectly comparing the detected exhaust gas temperature (TGi) with the presumed exhaust gas temperature (TG1), and for determining whether an abnormal condition occurs in the fuel injection amount; and a total determination means for identifying a portion in which the abnormal condition occurs, based on the determinations of the first and second determination means.

5. A common rail fuel injection system according to claim 4, wherein the second determination means determines an abnormal condition of "excess of fuel injection", in the case that the detected exhaust gas temperature (TGi) is higher than a predetermined normal range of the presumed exhaust gas temperature (TG1).

6. A common rail fuel injection system according to claim 4, wherein the second determination means determines that the fuel injection amount is in a normal condition, in the case that the detected exhaust gas temperature (TGi) is within the predetermined normal range of the presumed exhaust gas temperature (TG1), and the total determination means determines that a fuel leakage has occurred at portions other than the inside of the respective engine cylinders, in the case that first determination means determines the abnormal condition of "excess of fuel injection", whereas the second determination means determines the normal condition in the fuel injection amount.

7. A common rail fuel injection system according to claim 1, wherein the control unit further comprises;

a drive means for driving a warning device to indicate to a vehicle driver the abnormal condition in the fuel injection amount, based on the determination at the first determination means.

8. A common rail fuel injection system according to claim 5, wherein the control unit further comprises;

a drive means for applying a further limit to an upper limit of fuel injection amount, in the case that the first and second determination means determine the abnormal condition of "excess of fuel injection".

9. A common rail fuel injection system according to claim 6, wherein the control unit further comprises;

a drive means for stopping the operation of the engine, in the case that the total determination means determines that the fuel leakage has occurred at portions other than the inside of the respective engine cylinders.

* * * * *